US009595379B2

(12) United States Patent
Yeo et al.

(10) Patent No.: US 9,595,379 B2
(45) Date of Patent: Mar. 14, 2017

(54) COOLING DEVICE FOR TRANSFORMER

(71) Applicant: Hyundai Motor Company, Seoul (KR)

(72) Inventors: In Yong Yeo, Gyeonggi-Do (KR); Byeong Seob Song, Gyeonggi-Do (KR); Dae Woo Lee, Gyeongsangbuk-do (KR); Jin Young Yang, Gyeonggi-Do (KR); Woo Young Lee, Chungcheongbuk-do (KR)

(73) Assignee: Hyundai Motor Company, Seoul (KR)

( * ) Notice: Subject to any disclaimer, the term of this patent is extended or adjusted under 35 U.S.C. 154(b) by 144 days.

(21) Appl. No.: 14/568,739

(22) Filed: Dec. 12, 2014

(65) Prior Publication Data

US 2016/0064134 A1 Mar. 3, 2016

(30) Foreign Application Priority Data

Aug. 26, 2014 (KR) ..... 10-2014-0111205

(51) Int. Cl.

| | |
|---|---|
| ***H01F 27/08*** | (2006.01) |
| ***H01F 27/22*** | (2006.01) |
| ***H01F 27/02*** | (2006.01) |
| *F28F 3/00* | (2006.01) |

(52) U.S. Cl.

CPC ..... *H01F 27/22* (2013.01); *H01F 27/02* (2013.01); *H01F 27/08* (2013.01); *F28F 3/00* (2013.01)

(58) Field of Classification Search

CPC ..... H01F 27/00–27/30
USPC ..... 336/55–62
See application file for complete search history.

(56) References Cited

U.S. PATENT DOCUMENTS

| | | | | |
|---|---|---|---|---|
| 5,210,513 | A * | 5/1993 | Khan | H01F 27/22 336/233 |
| 5,469,124 | A * | 11/1995 | O'Donnell | H01F 27/06 336/210 |
| 6,392,519 | B1 * | 5/2002 | Ronning | H01F 27/22 336/61 |
| 7,164,584 | B2 * | 1/2007 | Walz | H01F 27/22 165/185 |
| 8,164,406 | B2 * | 4/2012 | Lin | H01F 27/2866 336/232 |
| 2003/0197583 | A1 * | 10/2003 | Choi | H01F 27/12 336/58 |

(Continued)

FOREIGN PATENT DOCUMENTS

| | | |
|---|---|---|
| JP | 07-297043 | 11/1995 |
| JP | 1996-008118 A | 1/1996 |

(Continued)

*Primary Examiner* — Tuyen Nguyen
(74) *Attorney, Agent, or Firm* — Mintz Levin Cohn Ferris Glovsky and Popeo, P.C.; Peter F. Corless

(57) ABSTRACT

A cooling device for a transformer, capable of reducing heat generation from windings and a core, is provided. The cooling device for the transformer includes a primary winding and a second winding wound around a center part of the core and separated from each other. A heat-dissipating panel for releasing heat generated from the core, the primary winding, and the secondary winding to the exterior using heat conductance is inserted between the primary winding and the secondary winding. In addition, the heat-dissipating panel is configured to release heat using exposed edges of the primary winding and the secondary winding.

7 Claims, 5 Drawing Sheets

(56) References Cited

U.S. PATENT DOCUMENTS

2008/0079524 A1* 4/2008 Suzuki ..... H01F 27/2804
336/61

FOREIGN PATENT DOCUMENTS

| | | | |
|---|---|---|---|
| JP | 2006-041353 | A | 2/2006 |
| JP | 2009-194199 | A | 8/2009 |
| JP | 2012-160616 | A | 8/2012 |
| KR | 10-0774673 | B1 | 11/2007 |
| KR | 20-2010-0002141 | | 3/2010 |

* cited by examiner

COOLING DEVICE FOR TRANSFORMER

CROSS-REFERENCE TO RELATED APPLICATION

This application claims under 35 U.S.C. §119(a) the benefit of Korean Patent Application No. 10-2014-0111205 filed on Aug. 26, 2014, the entire contents of which are incorporated herein by reference.

BACKGROUND

Technical Field

The present disclosure relates to a cooling device for a transformer, and more particularly, to a cooling device for a transformer that reduces heat generation from a transformer disposed within a battery charger of an eco-friendly vehicle.

Background Art

In general, an eco-friendly vehicle, (e.g., Plug-in Hybrid Electric Vehicle (PHEV) or Electric Vehicle (EV)) includes an on board charger (OBC) configured to charge a high-voltage battery that is a power supply of a driving motor. The OBC receives alternating current (AC) power from an external power supply to charge the battery. An OBC circuit for an eco-friendly vehicle is generally configured in the form of a combination of a power factor corrector (PFC) and a full bridge converter, and a transformer is disposed between the PFC and the full bridge converter to be isolated from high-voltage battery.

However, heat generation from the transformer within the OBC circuit may be substantial, and to reduce heat generation from the transformer, various methods such as using a molding structure have been used. Such methods may have several problems that include increasing production costs and exhibiting difficulties in manufacturing.

An exemplary sectional view of a transformer for OBC according to a related art is shown in FIG. 5. Referring to FIG. 5, the transformer for OBC according to a related art requires leakage inductance (generally, 10 uH or more) to ensure zero voltage switching (ZVS) of a phase shift full bridge (PSFB) circuit. Further, to generate such leakage inductance, a primary winding 1 is separated from a secondary winding 2. To support the primary winding 1 and secondary winding 2 and maintain the gap between the primary and secondary windings 1 and 2, a bobbin 3 is inserted between the primary and second windings 1 and 2, and the bottom of a core 5 contacts a heat sink 4 to dissipate heat.

Within the transformer according to the related art, a substantial amount of heat is generated from the primary and second windings 1 and 2, and due to the generated heat, the temperature of the transformer may increase. However, since the bottom of the core 5, around which the primary and secondary windings 1 and 2 are wound, is cooled, temperature specifications may be difficult to meet.

Accordingly, to reduce heat generation from a transformer, a method of molding a transformer, a method of installing a heat-dissipating panel on an outer side of a core, etc. have been used. However, since the method of molding the transformer additionally requires a plastic or an aluminum case and molding liquid (e.g., silicon having high thermal conductivity), production costs may increase substantially, and the volume of the transformer may increase. Meanwhile, the installation of the heat-dissipating panel may have a low (e.g., minimal) effect on temperature reduction of the inside of the core and windings since the panel reduces the temperature of an outer side of the core.

The above information disclosed in this section is merely for enhancement of understanding of the background of the invention and therefore it may contain information that does not form the prior art that is already known in this country to a person of ordinary skill in the art.

SUMMARY

The present disclosure relates to a cooling device for a transformer that reduces heat generation from windings and a core by inserting a heat-dissipating panel between a primary winding and a secondary winding wound around the substantially center part of the core to release heat from the center part of the core, the primary winding, and secondary winding to an exterior of the transformer.

The present invention provides a cooling device for a transformer that may include a core formed of a magnetic material, and a primary winding and a second winding wound around (e.g., wrapped around) a substantially center part of the core and separated from each other, wherein a heat-dissipating panel may be inserted between the primary winding and the secondary winding to release heat generated from the core, the primary winding, and the secondary winding to an exterior of the transformer using heat conductance, and the heat-dissipating panel may be configured to release heat transmitted from the core, the primary winding, and the secondary winding using exposed edges of the primary winding and the secondary winding.

The heat-dissipating panel may protrude outward from the first winding and the secondary winding, and may be heat-conductively coupled with a heat sink disposed, in a stacked form, at a bottom of the core. Further, the cooling device may include thermal pads inserted between the heat-dissipating panel and the primary winding and between the heat-dissipating panel and the secondary winding, respectively, configured to increase thermal conductivity between the heat-dissipating panel and the primary winding and between the heat-dissipating panel and the secondary winding.

In another aspect, the present invention provides a cooling device for a transformer, that may include a core formed of a magnetic material, and a primary winding and a secondary winding wound around a substantial center part of the core and disposed to a right side and a left side to be separated from each other, wherein a heat-dissipating panel may be disposed at a top of the core and contact (e.g., is disposed adjacent to) both sides of the core and upper ends of the primary winding and the secondary winding to release heat generated from the core, the primary winding, and the secondary winding to an exterior of the transformer using heat conductance.

A heat sink may be disposed, in a stacked form, at a bottom of the core and configured to absorb heat and release the absorbed heat. In addition, the heat sink may contact (e.g., be disposed adjacent to) lower ends of the primary winding and the secondary winding and be configured to release heat generated from the primary winding and the secondary winding to an exterior of the transformer. Further, the heat sink may be heat-conductively coupled with the heat-dissipating panel disposed at the top of the core.

A thermal pad may be inserted between the heat-dissipating panel and the upper ends of the primary winding and the secondary winding and configured to increase heat conductivity between the primary winding, the secondary winding, and the heat-dissipating panel. Further, a thermal pad may be inserted between the heat sink and lower ends of the primary winding and the secondary winding configured to increase heat conductivity between the heat sink, the primary winding, and the secondary winding.

BRIEF DESCRIPTION OF THE DRAWINGS

The above and other features of the present invention will now be described in detail with reference to exemplary embodiments thereof illustrated the accompanying drawings which are given herein below by way of illustration only, and thus are not limitative of the present invention, and wherein.

Figure 1:
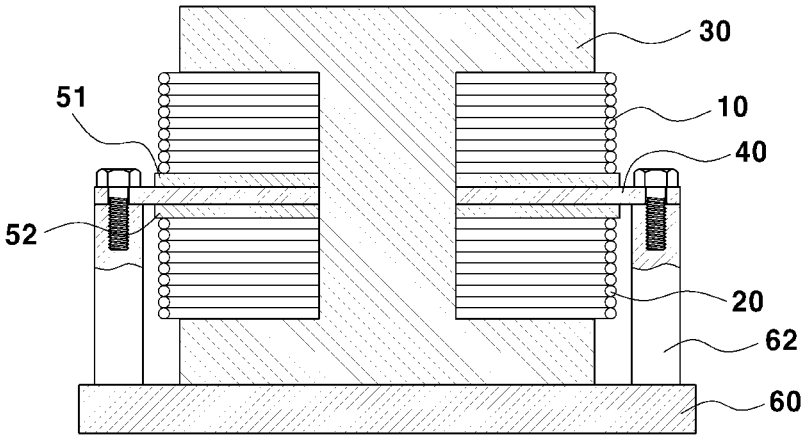
FIG. 1 is an exemplary cross-sectional view showing a cooling device for a transformer according to an exemplary embodiment of the present disclosure.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment. In the figures, reference numbers refer to the same or equivalent parts of the present invention throughout the several figures of the drawing.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Hereinafter reference will now be made in detail to various exemplary embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

FIG. 1 is an exemplary cross-sectional view showing a cooling device for a transformer according to an exemplary embodiment of the present disclosure. As shown in FIG. 1, according to an exemplary embodiment of the present disclosure, a primary winding 10 may be separated from a secondary winding 20. An apparatus for cooling the primary and secondary windings 10 and 20 and a core 30 may include a heat-dissipating panel 40 and a plurality of thermal pads 51 and 52 inserted between the primary winding 110 and the secondary winding 20 to increase leakage inductance of a transformer.

The core 30 may be a magnetic material and may have a substantially "I"-shaped cross-section. In addition, at a substantially center part of the core 30, the primary winding 10 and the secondary winding 20 may be disposed above and below each other and separated from each other, and a heat sink 60 may be disposed, in a stacked form, at the bottom of the core 30. The primary winding 10 may be formed by winding wires around the substantially center part of the core 30. Further, the secondary winding 20 may be formed by winding wires around the substantially center part of the core 30 and disposed below the primary winding 10.

The heat-dissipating panel 40 may be configured to release heat from the core 30 and the windings 10 and 20 to an exterior of a transformer. The heat-dissipating panel 40 may be formed in a shape of a plate with a predetermined thickness using a material that has substantially high thermal conductivity, such as copper or aluminum. The heat-dissipating panel 10 may be inserted between the primary winding 10 and the secondary winding 20. A plurality of fastening members 42 (see FIG. 2) configured to couple with the heat sink 60 may be disposed at individual corners of the heat-dissipating panel 10.

The heat-dissipating panel 40 may be configured to release heat generated from the substantially center part of the core 30 and the individual windings 10 and 20 to the exterior of a transformer using heat conduction. The heat-dissipating panel 40 may be configured to release heat from the edges exposed to the exterior of the transformer. Accordingly, the heat-dissipating panel 40 may protrude outward from the windings 10 and 20. In addition, the heat-dissipating panel 40 may be configured to support the primary and secondary windings 10 and 20, and maintain a gap between the primary and secondary windings 10 and 20. Further, by changing the thickness of the heat-dissipating panel 40, the gap between the primary and secondary windings 10 and 20 may be adjusted.

The heat sink 60 may contact (e.g., be disposed adjacent to) a bottom of the core 30 and be configured to absorb heat from the core 30 and dissipate the absorbed heat to the exterior of the transformer. The heat sink 60 may include a plurality of coupling members 62 with a predetermined height for coupling (e.g., heat-conductively connecting) with the heat-dissipating panel 40, at an upper surface, wherein the coupling members 62 protrude upward (e.g., vertically) from the heat sink 60.

Figure 2:
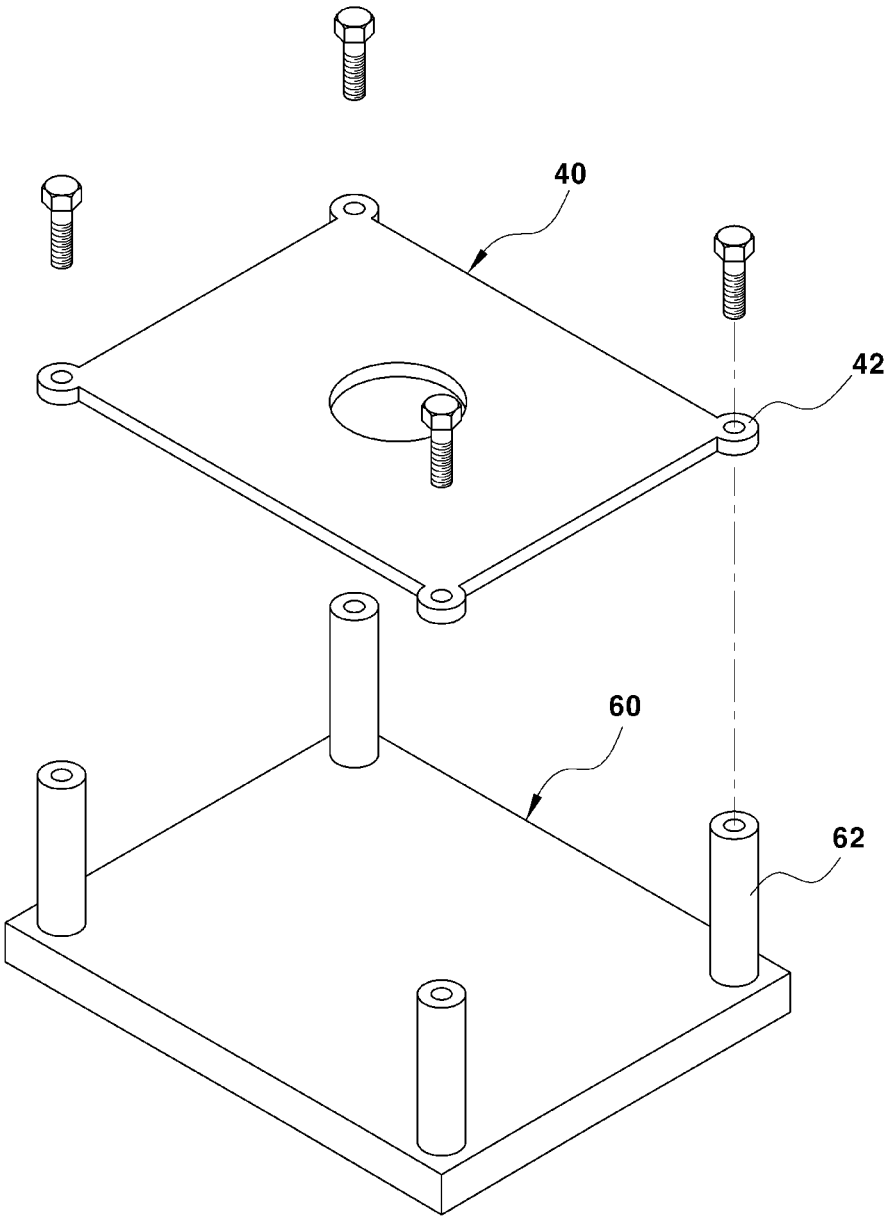
FIG. 2 is an exemplary perspective view showing a heat-dissipating panel and a heat sink of a cooling device for a transformer according to an exemplary embodiment of the present disclosure.

FIG. 2 is an exemplary perspective view showing the heat-dissipating panel 40 and the heat sink 62 of the cooling device for the transformer, according to an exemplary embodiment of the present disclosure. As shown in FIG. 2, the apparatus may include four fastening members 42 of the heat-dissipating panel 40, fastening members 42 coupled with the coupling members 62 of the heat sink 60 using bolts or the like. However, the number of the fastening members 42 and the coupling members 62 is not limited to four. In other words, the number of the fastening members 42 and the coupling members 62 may increase or decrease based on a degree of heat-dissipation.

The thermal pads 51 and 52 may be stacked above and below the heat-dissipating panel 40. In other words, the thermal pads 51 and 52 may be disposed between the primary winding 10 and the heat-dissipating panel 40 and between the secondary winding 20 and the heat-dissipating panel 40, respectively. In addition, the thermal pads 51 and 52 may be made of a substantially soft material with substantially high thermal conductivity, and contact the primary and secondary windings 10 and 20, respectively, to transmit heat generated from the primary and secondary windings 10 and 20 to the overall area of the heat-dissipating panel 40. In other words, the thermal pads 51 and 52 may be configured to improve thermal conductivity between the heat-dissipating panel 40 and the windings 10 and 20, and increase a heat-dissipating area with respect to the windings 10 and 20, which may provide more effective heat-dissipation. Accordingly, by inserting the thermal pads 51 and 52 between the heat-dissipating panel 40 and the windings 10 and 20 to an increase of a heat-dissipating area and improve of heat conductance, cooling of the transformer may be improved.

Since a transformer has greater temperature at an inner part of a core than at an outer part of the core due to magnetic flux interlinkage, and windings generate a greater amount of heat than the core, more efficient cooling may be achieved by inserting the heat-dissipating panel 40 with high thermal conductivity at the substantially center part of the core 30 where the primary winding 10 and the secondary winding 20 are disposed. The heat-dissipating panel 40 may be configured to cool the transformer by heat-dissipating the exterior of the transformer and transmitting heat to the heat sink 60. In other words, the heat-dissipating panel 40 may be configured to release heat transmitted from the primary and secondary windings 10 and 20 and the substantially center part of the core 30 to the exterior of the transformer, and simultaneously transmit a part of the heat to the heat sink 60 to emit the heat via the heat sink 60.

Figure 3:
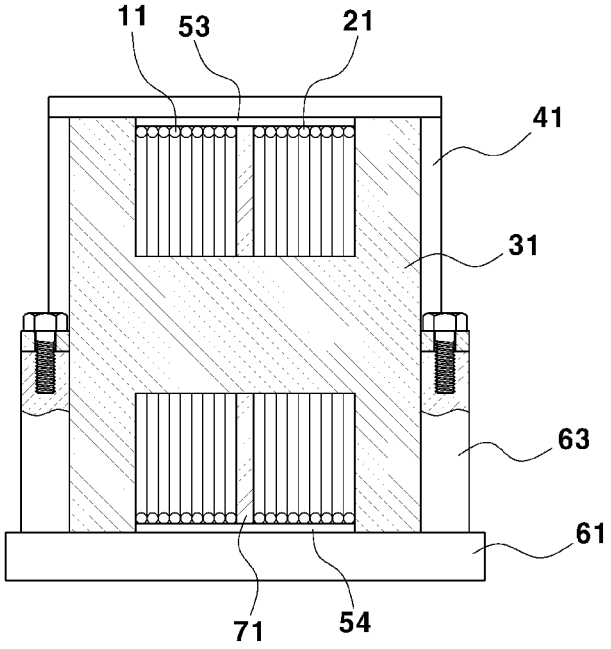
FIG. 3 is an exemplary cross-sectional view showing a cooling device for a transformer according to an exemplary embodiment of the present disclosure.
Figure 4:
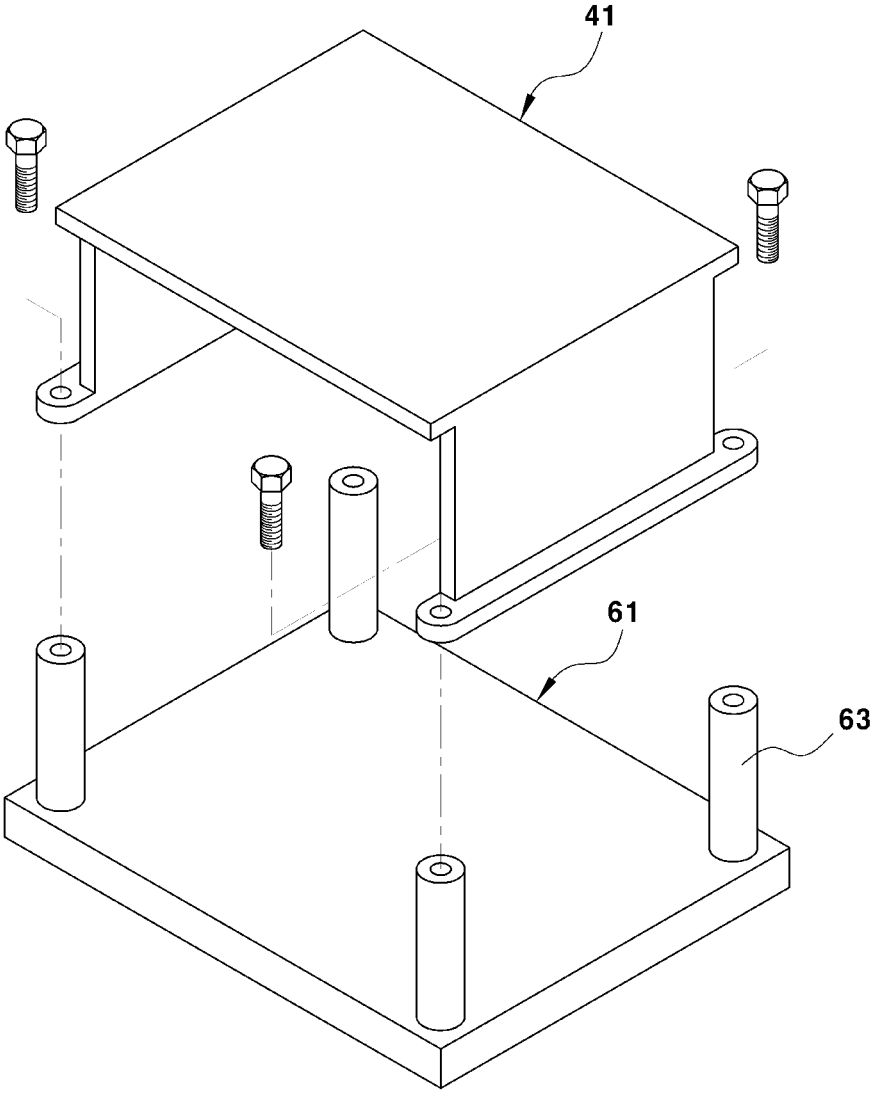
FIG. 4 is an exemplary perspective view showing a heat-dissipating panel and a heat sink of a cooling device for a transformer according to an exemplary embodiment of the present disclosure.
Figure 5:
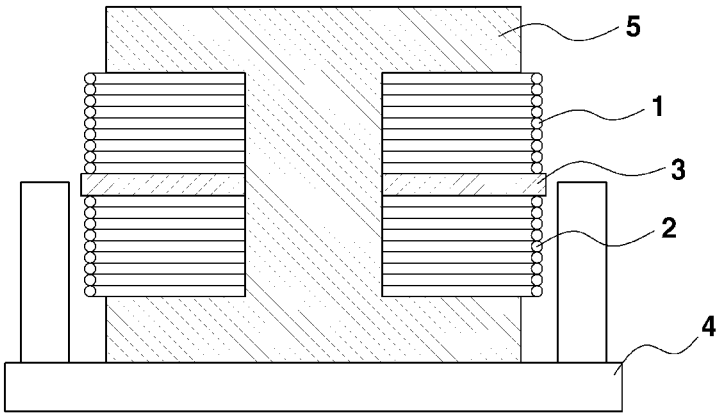
FIG. 5 RELATED ART
FIG. 5 is an exemplary cross-sectional view showing a cooling structure of a transformer for an On Board Charger (OBC) according an example of a related art.

FIGS. 3 and 4 show a transformer according to an exemplary embodiment of the present disclosure. More specifically, FIG. 3 is an exemplary cross-sectional view showing a cooling device for a transformer according to an exemplary embodiment of the present disclosure. FIG. 4 is an exemplary perspective view showing a heat-dissipating panel and a heat sink of a cooling device for a transformer according to an exemplary embodiment of the present disclosure.

As shown in FIG. 3, a heat-dissipating panel 41, a plurality of thermal pads 53 and 54, and a heat sink 61 may be used to more effectively cool both ends of primary and secondary windings 11 and 21 arranged at a substantially center part of a core 31. The core 31 may be a magnetic material with a substantially "H"-shaped cross-section, and at the center part of the core 31, the primary winding 10 and the secondary winding 20 may be disposed at a left side and a right side and separated from each other. The heat sink 60 may be disposed, in a stacked form, at the bottom of the core 31.

The primary winding 11 and the secondary winding 21 may be formed by winding wires around the substantially center part of the core 30, and the secondary winding 20 may be positioned to a left side or a right side of the primary winding 11. A bobbin 71, which may be in the form of a plate, may be inserted between the primary and secondary windings 11 and 21 configured to support the primary and secondary windings 11 and 21 and maintain the gap between the primary and secondary windings 11 and 21. The heat-dissipating panel 41 may be configured to release heat from the core 31 and the windings 11 and 21 to an exterior of the transformer. The heat-dissipating panel 41 may be made of a material with substantially high thermal conductivity, such as copper or aluminum.

Further, corners of a lower part (e.g., bottom) of the heat-dissipating panel 41 may be disposed over and coupled with coupling members 63 of the heat sink 61 to cool the core.

In addition, a left lateral part and a right lateral part of the heat-dissipating panel 41 may contact both sides of the core 31 to also cool the core 31. Further, the upper part of the heat-dissipating panel 41 may contact (e.g., be disposed adjacent to) upper ends (e.g., top) of the primary and secondary windings 11 and 21 and top of the core 31 through the thermal pads 53 and 54 to cool the primary and secondary windings 11 and 21.

The lower ends of the respective windings 11 and 21 and the bottom of the core 21 may contact (e.g., be disposed adjacent to) the heat sink 61 via the thermal pads 53 and 54. The thermal pads 53 and 54 may be made of a substantially soft material with substantially high thermal conductivity. The thermal pads 53 and 54 may be disposed between the heat-dissipating panel 41 and upper ends (e.g., top) of the windings 11 and 21 and between the heat sink 61 and lower ends (e.g., bottom) of the windings 11 and 21, respectively, to increase a heat-dissipating area of the windings 11 and 12, which may more effectively dissipate heat.

Since the primary and secondary windings 11 and 21 may be formed by winding wires around the center part of the core 31, the upper and lower ends of the windings 11 and 21 may have a nonplanar (e.g., not flat) shape. Accordingly, by disposing the thermal pads 53 and 54 that may be deformed within limits since they are made of a substantially soft material with substantially high thermal conductivity, between the heat-dissipating panel 41 and the upper ends of the windings 11 and 21 and between the heat sink 61 and the lower ends of the windings 11 and 21, respectively, contact area between the heat-dissipating panel 41 and the windings 11 and 21 and between the heat sink 61 and the windings 11 and 21 may increase a heat-dissipating area of the windings 11 and 21. Further, heat from the windings 11 and 21 may be transmitted to the overall areas (e.g., all) of the heat-dissipating panel 41 and the heat sink 61, which may dissipate heat more effectively.

As described above, the cooling devices for the transformer according to exemplary embodiments of the present disclosure may more effectively reduce the temperature of the substantially center part of the core that is subject to substantial heat generation due to magnetic flux interlinkage. Further, by adding the thermal pads between the heat-dissipating panel and the windings, heat may be more effectively dissipated to improve cooling performance. In addition, by changing the thickness of the heat-dissipating panel, the gap between the primary winding and the second winding may be adjusted. In addition, since the heat-dissipating panel is disposed at a location of a bobbin in the related art, production costs may be increase less than a typical molding method requiring a case and molding liquid.

The invention has been described in detail with reference to exemplary embodiments thereof. However, it will be appreciated by those skilled in the art that changes may be made in these exemplary embodiments without departing from the principles and spirit of the invention, the scope of which is defined in the appended claims and their equivalents.

What is claimed is:

1. A cooling device for a transformer, wherein the transformer includes a core formed with a magnetic material, and a primary winding and a second winding wound around a substantially center part of the core and separated from each other, comprising:

a heat-dissipating panel disposed between the primary winding and the secondary winding and configured to release heat generated from the core, the primary winding, and the secondary winding to an exterior of the transformer using heat conductance and exposed edges of the primary winding and the secondary winding; and a heat sink contacting a bottom of the core and configured to absorb heat from the core and dissipate the absorbed heat to the exterior of the transformer, the heat sink including a plurality of coupling members with a predetermined height at an upper surface thereof, wherein the coupling members protrude upward from the heat sink, and wherein the heat-dissipating panel protrudes outward from the primary winding and the secondary winding, and the protruded portion of the heat-dissipating panel is heat-conductively coupled with the coupling member.

2. The cooling device of claim 1, further including:

a thermal pad disposed between the heat-dissipating panel and the primary winding to increase thermal conductivity between the heat-dissipating panel and the primary winding.

3. The cooling device of claim 1, further including:

a thermal pad disposed between the heat-dissipating panel and the secondary winding to increase thermal conductivity between the heat-dissipating panel and the secondary winding.

4. The cooling device of claim 1, wherein the heat-dissipating panel is heat-conductively coupled with a heat sink disposed, in a stacked form, at a bottom of the core.

5. A cooling device for a transformer, wherein the transformer includes a core formed with a magnetic material, and a primary winding and a secondary winding wound around a center part of the core and arranged right and left to be separated from each other, comprising:

a heat-dissipating panel disposed at a top of the core, wherein the heat-dissipating panel contacts both sides of the core and upper ends of the primary winding and the secondary winding to release heat generated from the core, the primary winding, and the secondary winding to the exterior of the transformer using heat conductance;

a heat sink disposed, in a stacked form, at a bottom of the core configured to absorb heat and release the absorbed heat; and a thermal pad disposed between the heat sink and lower ends of the primary winding and the secondary winding to increase heat conductivity between the heat sink, the secondary winding, and the heat-dissipating panel, wherein the heat sink contacts lower ends of the primary winding and the secondary winding to release heat generated from the primary winding and the secondary winding to the exterior of the transformer, wherein the heat sink includes a plurality of coupling members with a predetermined height at an upper surface thereof, and wherein the coupling members protrude upward from the heat sink and the protruded portions of the coupling members are heat-conductively coupled with the heat-dissipating panel contacting both sides of the core.

6. The cooling device of claim 5, wherein the heat sink is heat-conductively coupled with the heat-dissipating panel disposed at a top of the core.

7. The cooling device of claim 5, further including:

a thermal pad disposed between the heat-dissipating panel and upper ends of the primary winding and the secondary winding to increase heat conductivity between the primary winding, the secondary winding, and the heat-dissipating panel.

* * * * *